US005779246A

United States Patent [19]

Bengtsson

[11] Patent Number: 5,779,246

[45] Date of Patent: Jul. 14, 1998

[54] SKATE

[75] Inventor: Kent Bengtsson, Örebro, Sweden

[73] Assignee: Örebroskenan Aktiebolag, Orebro, Sweden

[21] Appl. No.: 646,334

[22] PCT Filed: Nov. 18, 1994

[86] PCT No.: PCT/SE94/01102

§ 371 Date: Jun. 3, 1996

§ 102(e) Date: Jun. 3, 1996

[87] PCT Pub. No.: WO95/15095

PCT Pub. Date: Jun. 8, 1995

[30] Foreign Application Priority Data

Dec. 3, 1993 [SE] Sweden ..... 9304037

[51] Int. Cl.[6] ..... A63C 3/02

[52] U.S. Cl. ..... 280/11.12; 280/11.19; 36/89

[58] Field of Search ..... 280/11.12, 809, 280/841, 11.22, 11.23, 11.19; 36/1.5, 2 R, 2 B, 89, 92, 93, 115

[56] References Cited

U.S. PATENT DOCUMENTS

| | | | |
|---|---|---|---|
| 2,165,879 | 7/1939 | Wilkinson | 36/8.5 |
| 3,798,800 | 3/1974 | Rathmell | 36/2.5 AL |
| 3,828,448 | 8/1974 | Leonildo | 36/2.5 AL |
| 4,826,183 | 5/1989 | Bratland et al. | 280/11.12 |

*Primary Examiner*—Richard M. Camby

*Attorney, Agent, or Firm*—Sughrue, Mion, Zinn, Macpeak & Seas, PLLC

[57] ABSTRACT

An ice skate which includes an outer shoe (1), a blade attached to the sole of the outer shoe, and an inner shoe (9) which is fitted in the outer shoe and which embraces at least the rear part of the foot, including heel and ankle. The inner shoe (9) is fitted in the outer shoe so as to be pivotal about an axis (10) which extends transversely across the inner sole of the outer shoe (1), forwardly of the ankle joint. That part of the sole of the inner shoe (9) located rearwardly of the pivot axis is free in relation to the inner sole of the outer shoe, therewith enabling the rear part of the inner shoe to accompany and guide the foot upon limited upward movement of the heel part of the foot.

6 Claims, 4 Drawing Sheets

SKATE

BACKGROUND OF THE INVENTION

The present invention relates to an ice skate which includes an outer shoe, a blade mounted on the sole of the outer shoe, and an inner shoe which is fitted in the outer shoe and which surrounds at least the rear part of the wearer's foot, including heel and ankle.

A conventional ice-hockey skate includes a hard boot which is laced up in a traditional manner, with the laces being threaded through eyelets or holes, from a hard toe cap, past the ankle joint to the beginning of the shinbone. The purpose of this lacing is to provide the stablest possible connection between foot and boot. The boot is often made of a combination of plastic and leather, partly to protect the wearer's foot against blows and puck impacts, and partly to provide stability so that the foot is unable to twist or move sideways. This stability is necessary in order to transmit power from the foot to the leg. In principle, the same conditions prevail in ice hockey as those that prevail in downhill alpine skiing sports, where it is endeavoured to transmit power from the legs to the skis rather than from the feet, since the leg muscles constitute the strongest muscular unit of the body.

Lateral stability is normally achieved at the cost of longitudinal mobility. As a result, the majority of ice-hockey players do not lace their skates up to the shinbone, but only as far as the ankle joint, and then tape the skate firmly to the leg guard, or shin guard, from the ankle and upwards. This is because tape is more elastic than boot laces and allows a certain degree of movement longitudinally. The extent of this taping will vary in accordance with the strength of each player's feet.

Typical lacing of an ice-skate boot prevents the foot from lifting from the inner sole of the boot, and the foot will therefore constantly have the same relative position to the blade. This is unnatural and does not occur with any other type of shoe, and, among other things, sudden accelerations of the wearer when skating will not be as powerful as they would otherwise be if the foot could be flexed.

In an attempt to solve this problem, it has earlier been proposed that the ice-skate boot be secured to the blade in a manner which enables the rear part of the boot to move relative to the boot in a manner similar to a conventional ski boot, see EP-A2-0 192 312 and U.S. Pat. No. 1,789,182. The use of a divided blade has also been proposed, such that the rear part of the blade can be lifted together with the boot, see U.S. Pat. No. 1,751,692. None of these solutions, however, provide the stability between ice skate and foot/lower leg that is required when playing ice hockey, among other sports.

SUMMARY OF THE INVENTION

The main object of the present invention is to provide an ice skate which will allow a certain degree of mobility to the rear part of the foot while maintaining lateral stability between foot and boot.

The invention is based on the concept that this object can be achieved by using a partially movable inner shoe in an outer shoe and lacing the inner shoe firmly around the rear part of the foot and the ankle, therewith replacing the taping that is applied at present to afford a certain degree of mobility in the longitudinal direction. Because the outer shoe embraces the lower part of the foot up to and including the ankle and firmly connects the lower foot part with the blade as a result of lacing the outer shoe, lateral stability will be retained despite having improved the longitudinal mobility.

It has earlier been proposed to place an ankle support in an ice-skate boot, see U.S. Pat. No. 2,165,879. This ankle support, however, is not intended to hold firm the rear and the upper part of the foot, as is made evident by the statement that the ankle support can be used either with or without laces. The ankle support would also appear to be fixed firmly in the ice-skate boot, and can therefore not solve the problem that is solved by the present invention. U.S. Pat. No. 1,743, 689 also describes an ankle support which is fixedly mounted in an outer ice-skate boot. This known ankle support does not solve the problem either.

An ice skate of the kind defined in the first paragraph above and constructed in accordance with the present invention is particularly characterized in that the inner shoe is so fitted in the outer shoe as to be pivotal about an axis which extends transversely across the inner sole of the outer shoe and forwardly of the ankle joint; and in that the part of the sole of the inner shoe located behind this pivot axis is free in relation to the inner sole of the outer shoe, so that the rear part of the inner shoe is able to accompany and guide foot movement with limited upward movement of the heel part of the foot.

The outer shoe of an inventive ice skate will therewith hold the foot firm so that it cannot turn in relation to the blade, whereas the inner shoe will allow movement in the natural upward/forward direction of foot movement in conjunction with a skating stride, while maintaining stability.

In this regard, the inner shoe and the outer shoe are preferably provided with mutually coacting means which function to guide the inner shoe in the outer shoe in limited upward pivotal movement of the inner shoe in relation to the outer shoe. These guide means may include an arcuate guide mounted in one shoe, and means coacting with the arcuate guide mounted in the other shoe.

The inner shoe is preferably intended to be laced firmly around the foot with the aid of a lace which extends at least from the ankle and up over the ankle joint, and the outer shoe is preferably intended to be laced firmly around the foot from the toe cap up to at least the upper part of the foot, or dorsum.

In the case of a particularly preferred embodiment, the laces of the outer and the inner shoe overlap one another along a part of the dorsum so as to join or bind the shoes together, and the inner shoe lacing above this part is adapted to produce a harder grip around the foot than the outer shoe.

This embodiment utilizes the feature of lacing with one and the same lace that passes from the outer shoe to the inner shoe immediately in front of the ankle joint, wherewith the hard outer shoe holds the foot in place from the location of the toe cap to a location above the dorsum. This provides an area of stability which extends from the dorsum and obliquely rearwards to the heel, and up over the ankle knuckles. Overlapping of the laces connects the outer shoe with the inner shoe and therewith provides a smooth transition between stability in the outer shoe and stability in the inner shoe.

Lacing then continues up on the inner shoe and over the ankle, therewith tightening the inner shoe from the underside of the heel and up over the ankle knuckles towards the lower leg. As a result, the transition between the hard outer shoe and the softer, more pliant inner shoe will have no adverse effect on the movement of the foot in the longitudinal direction. Movement in the longitudinal direction does not influence the stability of the outer shoe, since the outer shoe is firmly laced on the wearer's foot up over the dorsum.

The total stability of the ice skate is maintained because when the leg is straight and the foot is angled normally, the foot will be acted upon essentially by a force exerted by the laces of the outer shoe from the dorsum to the rear side of the leg, whereas when the leg is angled forwards the influence of the force thus generated will pass to the lacing of the inner shoe, which provides power from the dorsum to the heel. This movement increases the pressure across the heel while maintaining the pressure across the ankle knuckles. As a result, the stability of the foot remains unchanged in conjunction with natural upward and forward foot movement.

BRIEF DESCRIPTION OF THE FIGURES

The invention will now be described in more detail with reference to exemplifying embodiments thereof and also with reference to the accompanying drawings, in which.

DETAILED DESCRIPTION OF PREFERRED EMBODIMENT

Figure 1:
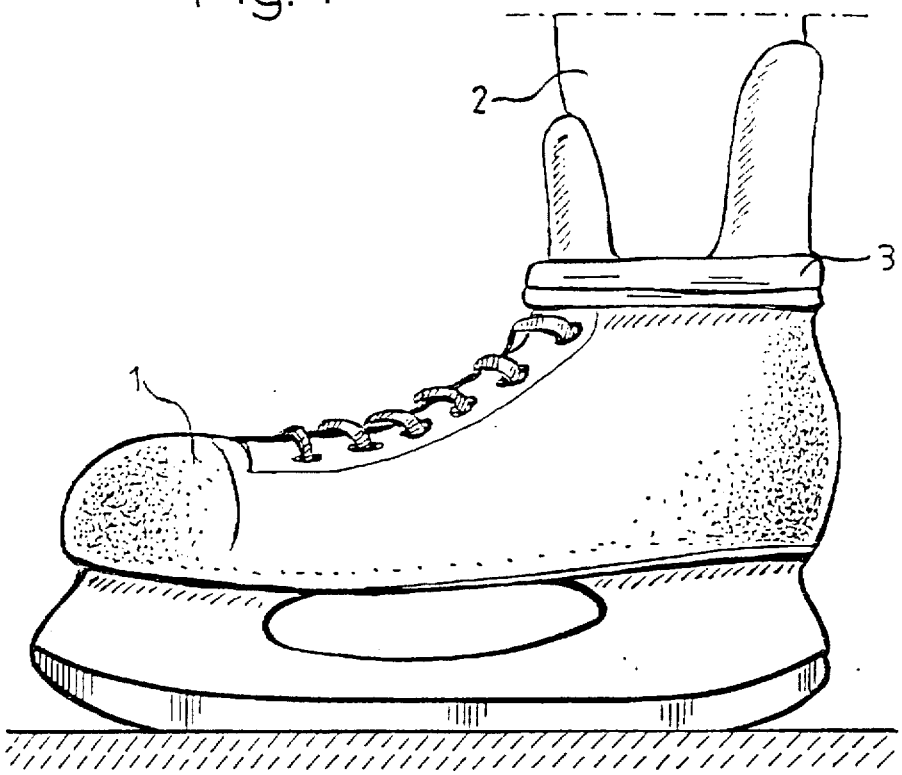
FIG. 1 illustrates a traditional ice skate with leg taping.

FIG. 1 illustrates an ice-hockey skate which includes a hard shoe or boot 1 which is laced approximately to the ankle joint, from where the lace is replaced with tape 3 so as to permit a certain degree of forward movement of the leg 2. The tape, however, also results in a degree of lateral instability.

Figure 1A:
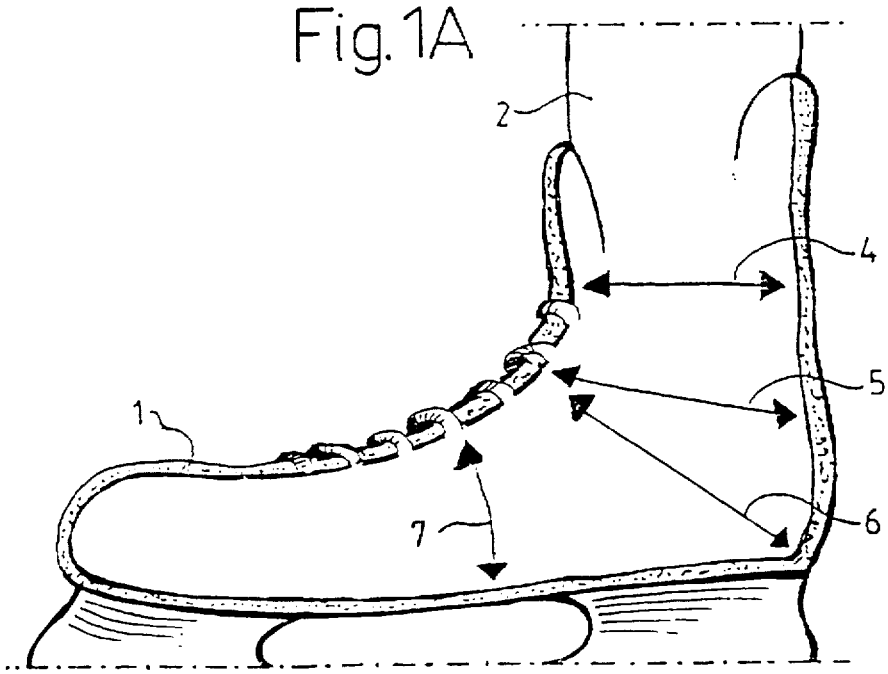
FIGS. 1A and 1B are sectional views of an ice skate according to FIG. 1, and show the ice skate fully laced and respectively with the leg straight and with the leg bent forwards.

The sectional view of FIG. 1A shows how the forces are distributed when the leg 2 is straight and the foot is positioned at an angle of substantially 90°. The lacing creates a constant pressure over the lower leg 4, over the ankle bone (talus) 5 and over the heel 6, and reduces slightly over the dorsum or upper foot 7. These are the normal pressures that are distributed over the foot to create the stability required. No pressure should be exerted further forwards than the metatarsal bones, which allows the toe part to move.

Figure 1B:
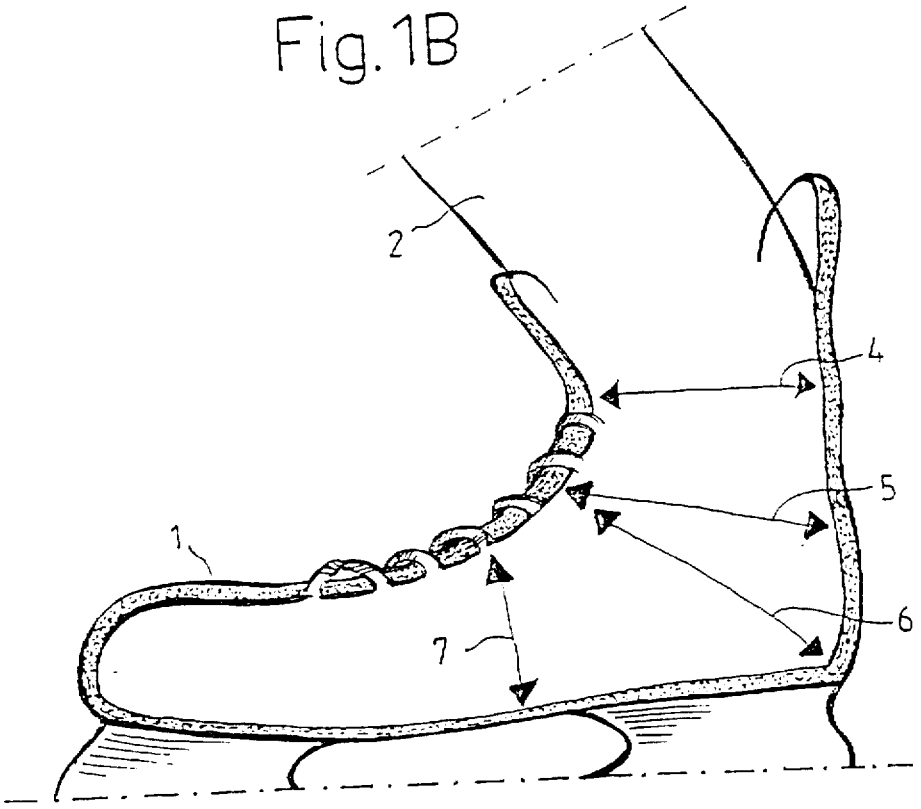

When the body and the leg 2 are bent forwards, the pressure across the lower leg 4 and the ankle bone (talus) 5 will greatly increase, see FIG. 1B. The pressure across the heel 6 also increases, wherewith the foot endeavours to bend upwards/forwards. The pressure across the dorsum 7 will not increase when the ice skate is tightly laced, since this pressure is counteracted by an increase in pressure across the heel. As a result, the whole of the ice skate is lifted forwards during said movement and the skater will "stand on tiptoe". This results in the skater taking shorter strides and not utilizing entirely the extended leg movement.

Figure 2:
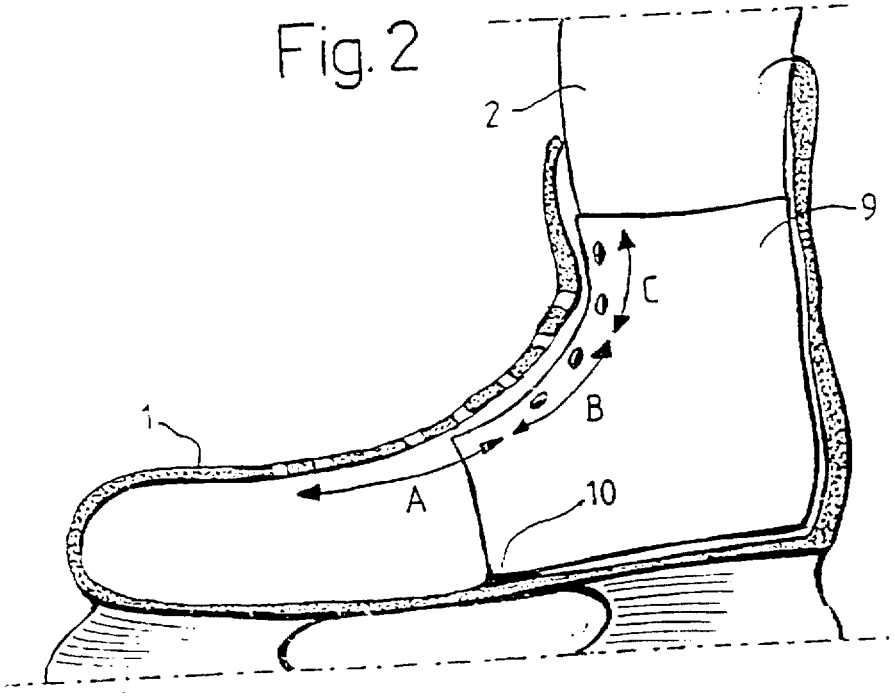
FIG. 2 is a sectional view of an ice skate constructed in accordance with the present invention.

FIG. 2 illustrates an inventive ice skate having a partially movable inner shoe 9 which is pivotally joined to the inner sole of the outer shoe 1 along a transverse axis line 10. In the case of the illustrated embodiment, the outer shoe 1 is laced along the part A, whereas the outer shoe and the inner shoe 9 share a common lace along the part B. Only the inner shoe is laced along the part C. The pivot axis 10 is located essentially straight beneath or immediately in front of the position at which lacing switches from the outer shoe to the inner shoe.

Figure 2A:
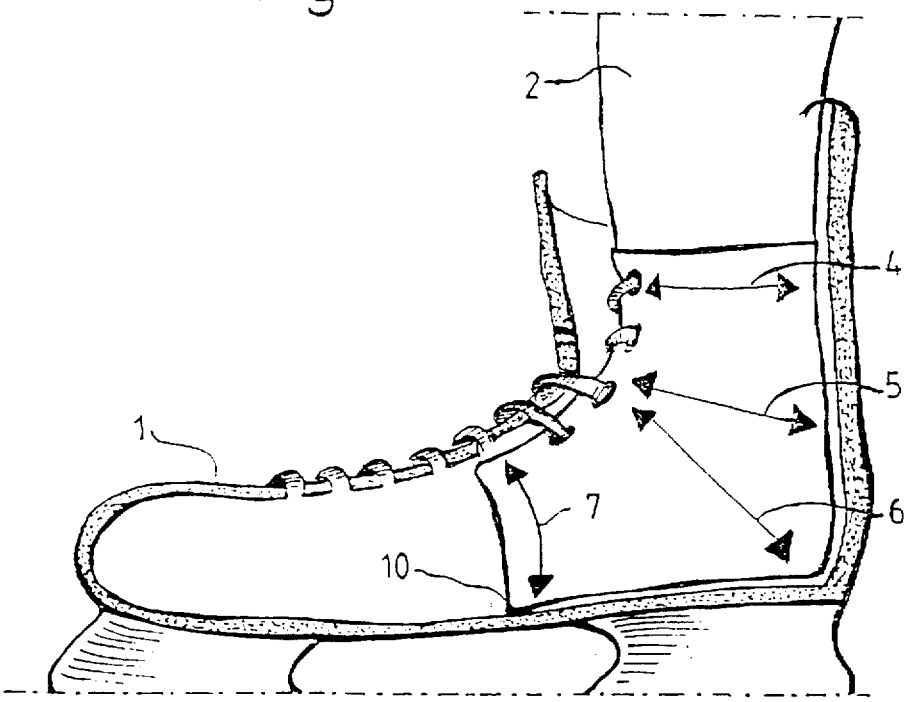
FIGS. 2A and 2B illustrate the ice skate shown in FIG. 2 and also show the holding forces that prevail when the leg is straight and when the leg is bent forwards respectively.

As shown in FIG. 2A, when the shoe is laced the pressure across the lower leg 4 is generated totally by the inner shoe 9, and the major part of the pressure over the ankle bone (talus) 5 is created by the inner shoe but with a contribution from the outer shoe, the lacing eyelets of which take over lacing immediately beneath this point. The major part of the pressure across the heel 6 will be generated by the outer shoe 1, but also to a lesser extent by the inner shoe, which, when fitted, embraces the heel. On the other hand, the pressure acting over the dorsum 7 will be generated totally by the outer shoe and will be the same as the pressure generated by a traditional ice skate. When skating with a straight leg, the skater will not notice any difference to a traditional ice skate.

Figure 2B:
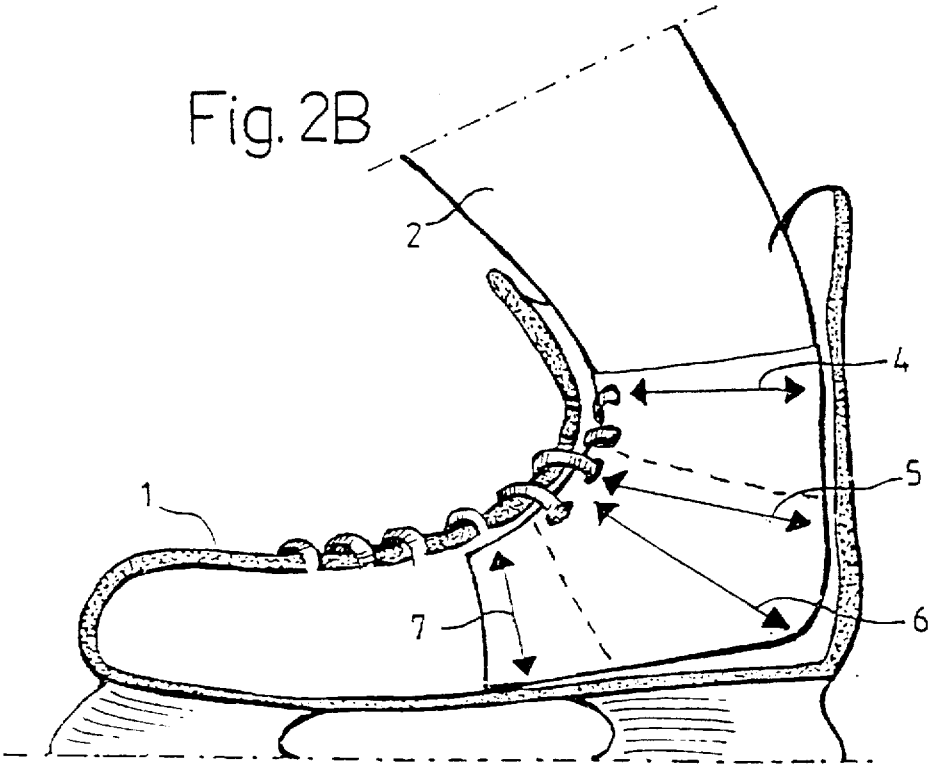

As shown in FIG. 2B, when the leg 2 is bent forwards while wearing an inventive skate, the pressure across the lower leg 4 will be maintained, since the inner shoe accompanies this forward movement of the leg. The pressure across the ankle bone 5 will also be maintained as a result of the inner shoe accompanying the movement of the foot. The pressure across the heel 6 will increase with the movement, but not to the same extent as that experienced with a traditional ice skate, since the inner shoe 9 still exerts part of the pressure influence and in this position can still be lifted slightly. The pressure over the dorsum 7 remains unchanged.

Despite movement of the leg 2 the stability of the foot will be maintained, since the sum of the holding forces around the foot will not decrease as a result of the change in position of the leg. The pressure across the lower leg 4 and the ankle bone (talus) 5 will remain unchanged, because the inner shoe is flexible in this position. As a whole, an ice skate of this construction will provide for more effective skating than a conventional ice skate.

The extent to which such movement can be allowed is determined individually by the point at which lacing switches from the outer shoe to the inner shoe. Because the eyelets on the inner shoe are parallel with the eyelets on the outer shoe, the player can himself/herself decide at which eyelet the transition from outer shoe lacing to inner shoe lacing shall take place. When this transition of the lacing between outer shoe and inner shoe takes place high up on the foot, foot movement will be influenced more by the pressure of the outer shoe, which affords smaller movement possibilities. On the other hand, when the transition takes place lower down on the foot the ability to move the leg becomes greater.

The inner shoe is conveniently made of a leather material which will adapt to the shape of the foot while nevertheless being sufficiently rigid to provide an effective foot support.

Figure 3A:
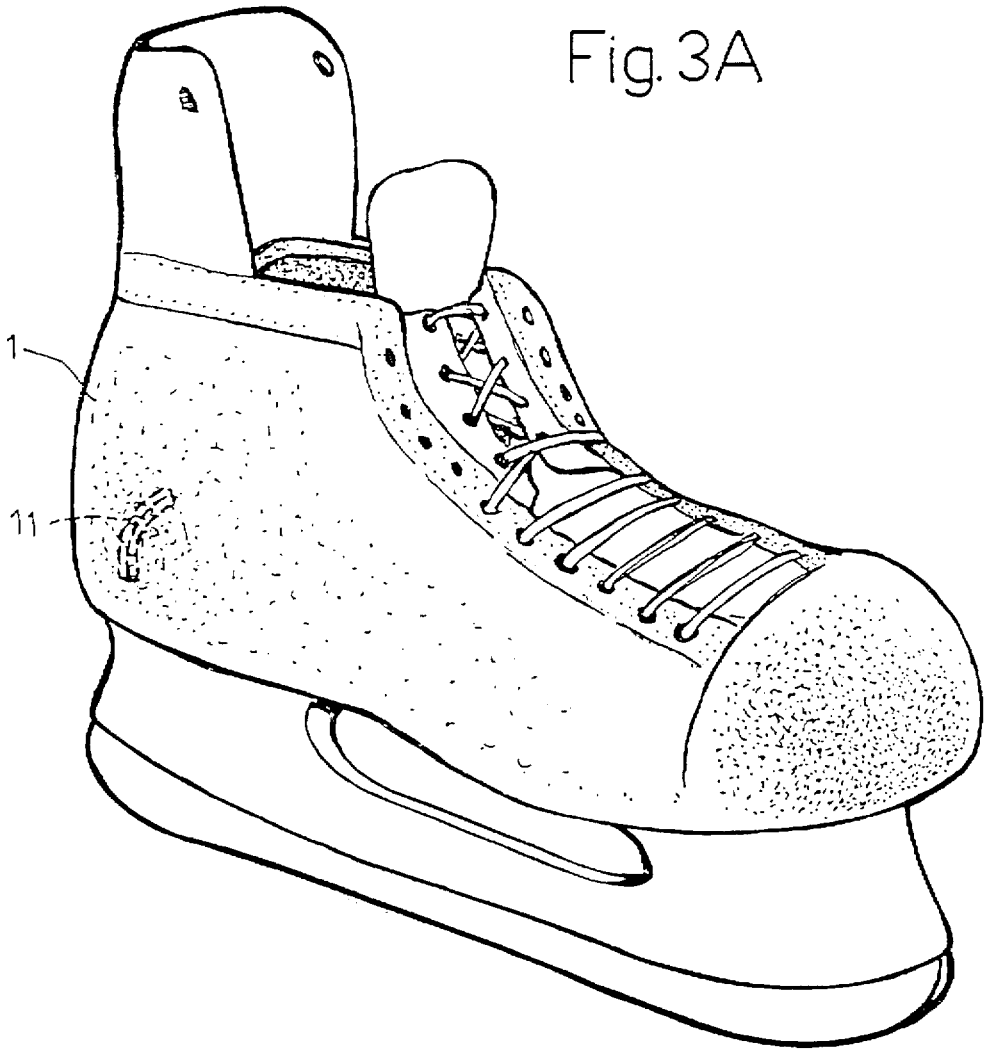
FIGS. 3A and 3B illustrate respectively an inventive skate and an inner shoe used therewith.
Figure 3B:
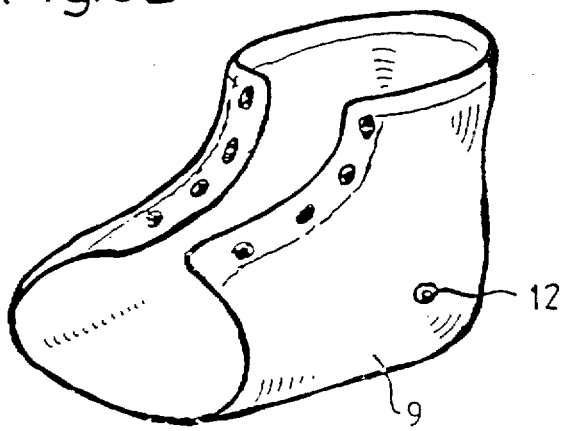

FIG. 3A is a perspective view of an inventive ice skate which includes an outer shoe 1 and an inner shoe 9, whereas FIG. 3B is a separate view of the inner shoe 9.

In the illustrated embodiment, lacing switches from the outer shoe 1 to the inner shoe 9 at the lower lacing eyelets of the inner shoe. Alternatively, as mentioned above, the lace can connect the outer and the inner shoes over a given part thereof. Furthermore, in the case of this embodiment, the outer shoe can be loosely laced with separate lacing which extends to the full extent of the boot. It will be understood that the inner shoe need not be shortened as in the case of the shoe shown in FIG. 3B, but may extend to the toe part of the ice skate 2. However, it is important that the rear part of the inner shoe is not fixed to the inner sole of the outer shoe, but is movable relative thereto.

In order to further stabilize the inner shoe 9 in the outer shoe 1 and therewith provide a firm guide as the inner shoe moves upwards, the outer shoe is conveniently provided internally with a guide bar 11 or corresponding device, wherein a device 12 which coacts with the guide bar 11 is mounted on the outside of the inner shoe 9. As illustrated, the guide bar is slightly arcuate in shape, so as to guide the inner shoe in a correct manner. As will be understood, the inventive principles can be applied with ice skates that are intended for other purposes than ice hockey, such as for ice-bandy, speed-skating and long-distance skating. Those variations that are required to adapt the ice skate to the particular requirements placed thereon with each application can be readily carried out by the person skilled in this art and lie within the scope of the present invention.

I claim:

1. An ice skate, comprising an outer shoe (1), a skate blade attached to sole of the outer shoe, and an inner shoe (9) disposed within the outer shoe and which embraces at least the rear part of a user'foot, including heel and ankle, wherein the inner shoe is so fitted in the outer shoe as to be pivotal about an axis (10) which extends transversely across the inner sole of the outer shoe and forwardly of the ankle joint; and a part of the sole of the inner shoe located rearwardly of the pivot axis is free in relation to the inner sole of the outer shoe such that the rear part of the inner shoe is able to accompany and guide the foot with limited upward movement of the heel part of the foot, and wherein the inner shoe is secured to the inner sole of the outer shoe along a transverse line which coincides with the pivot axle.

2. An ice skate according to claim 1, wherein the inner shoe and the outer shoe are provided with coacting means (11, 12) which function to guide the inner shoe in the outer shoe upon limited upward pivotal movement of the inner shoe in relation to the outer shoe.

3. An ice skate according to claim 2, wherein said connecting means include an arcuate guide (11) fitted to one shoe (1) and means (12) coacting with the arcuate guide and fitted to the other shoe (9).

4. An ice skate according to claim 1, wherein the inner shoe (9) is intended to be laced firmly around the user's foot, with the lace extending at least from the upper part of the foot, or dorsum, and up over the ankle joint.

5. An ice skate according to claim 4, wherein the outer shoe is intended to be laced firmly around the foot from the toe cap and up to at least the dorsum of the foot.

6. An ice skate according to claim 5, wherein the laces of the outer shoe and the inner shoe overlap one another over a part of the dorsum, or upper foot part, so as to join the shoes together; and the lacing of the inner shoe above this part is intended to produce a harder grip on the foot than the outer shoe.

* * * * *